US009574428B2

(12) United States Patent
Ramey, Jr. et al.

(10) Patent No.: US 9,574,428 B2
(45) Date of Patent: Feb. 21, 2017

(54) SCREENED PRODUCTION SLEEVE FOR MULTILATERAL JUNCTIONS

(71) Applicants: Mark E. Ramey, Jr., Houston, TX (US); Bryan P. Pendleton, Cypress, TX (US); Joseph Sheehan, Cypress, TX (US)

(72) Inventors: Mark E. Ramey, Jr., Houston, TX (US); Bryan P. Pendleton, Cypress, TX (US); Joseph Sheehan, Cypress, TX (US)

(73) Assignee: BAKER HUGHES INCORPORATED, Houston, TX (US)

( * ) Notice: Subject to any disclaimer, the term of this patent is extended or adjusted under 35 U.S.C. 154(b) by 413 days.

(21) Appl. No.: 14/138,771

(22) Filed: Dec. 23, 2013

(65) Prior Publication Data

US 2015/0176378 A1 Jun. 25, 2015

(51) Int. Cl.

| | |
|---|---|
| ***E21B 34/06*** | (2006.01) |
| ***E21B 43/08*** | (2006.01) |
| ***E21B 43/14*** | (2006.01) |
| ***E21B 41/00*** | (2006.01) |

(52) U.S. Cl.

CPC ..... *E21B 43/08* (2013.01); *E21B 41/0035* (2013.01); *E21B 41/0042* (2013.01)

(58) Field of Classification Search

CPC ..... E21B 34/12; E21B 34/14; E21B 43/08; E21B 43/10; E21B 43/14; E21B 43/30; E21B 43/305; E21B 41/0035

USPC ..... 166/313, 50, 205, 227

See application file for complete search history.

(56) References Cited

U.S. PATENT DOCUMENTS

| | | | | |
|---|---|---|---|---|
| 2,452,920 | A * | 11/1948 | Gilbert | E21B 7/061 166/117.5 |
| 5,337,808 | A * | 8/1994 | Graham | E21B 33/124 166/191 |
| 5,564,503 | A * | 10/1996 | Longbottom | E21B 7/061 166/117.6 |
| 5,715,891 | A * | 2/1998 | Graham | E21B 7/061 166/117.6 |
| 5,992,524 | A * | 11/1999 | Graham | E21B 7/061 166/117.6 |
| 6,994,165 | B2 * | 2/2006 | Roane | E21B 43/045 166/278 |
| 7,104,324 | B2 | 9/2006 | Wetzel et al. | |
| 7,213,654 | B2 * | 5/2007 | Plucheck | E21B 41/0042 166/117.5 |

(Continued)

OTHER PUBLICATIONS

PCT International Search Report and Written Opinion; International Application No. PCT/US2014/066520; International Filing Date: Nov. 20, 2014; Date of Mailing: Feb. 25, 2015; pp. 1-13.

*Primary Examiner* — Kenneth L Thompson
(74) *Attorney, Agent, or Firm* — Cantor Colburn LLP

(57) ABSTRACT

In one aspect, a wellbore system is disclosed that in one non-limiting embodiment includes a first wellbore capable of producing a fluid from a first formation, a second wellbore intersecting the first wellbore at a junction, wherein the second wellbore is an open hole and capable of producing a fluid from a second formation and a sand screen at the junction configured to inhibit particles larger than a selected size from flowing from the second wellbore and the junction into the first wellbore.

18 Claims, 1 Drawing Sheet

(56) References Cited

U.S. PATENT DOCUMENTS

| | | | | |
|---|---|---|---|---|
| 8,485,259 | B2 * | 7/2013 | Sponchia | E21B 41/0035 166/177.5 |
| 2002/0100588 | A1 | 8/2002 | Murray et al. | |
| 2004/0149444 | A1 * | 8/2004 | Cavender | E21B 41/0042 166/313 |
| 2004/0159435 | A1 | 8/2004 | Plucheck et al. | |
| 2006/0266531 | A1 | 11/2006 | Hepburn et al. | |
| 2011/0139444 | A1 * | 6/2011 | Cavender | E21B 43/16 166/250.01 |
| 2012/0175112 | A1 | 7/2012 | Atkinson et al. | |

* cited by examiner

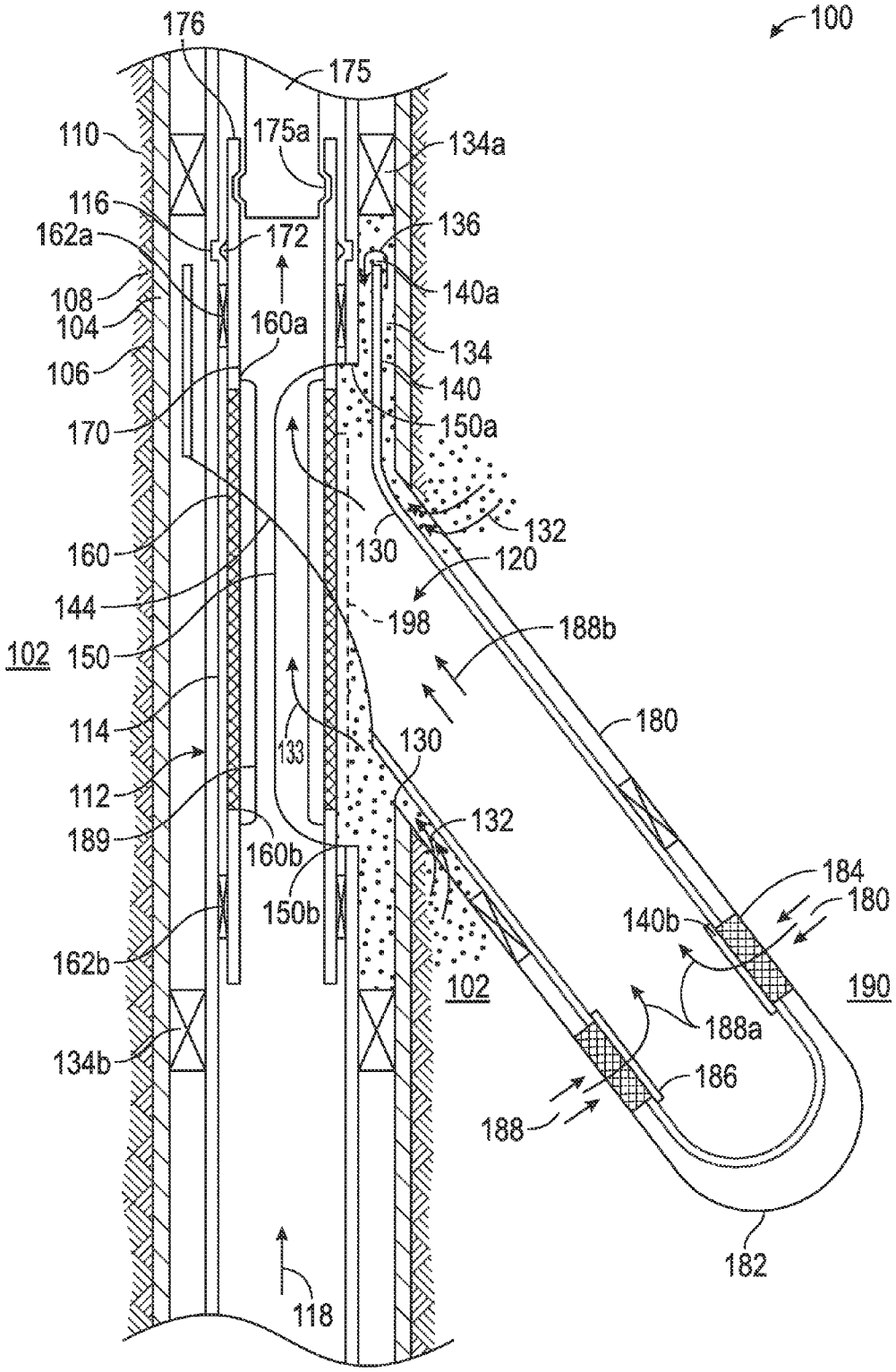
100
176
175
175a
110
134a
116
136
162a
172
108
140a
104
160a
134
106
140
170
150a
132
160
130
120
144
198
188b
102
150
180
114
133
130
112
132
189
160b
184
180
150b
140b
162b
102
190
188a
134b
186
188
182
118

SCREENED PRODUCTION SLEEVE FOR MULTILATERAL JUNCTIONS

BACKGROUND

1. Field of the Disclosure

This disclosure relates generally to wellbore systems, including multilateral wellbore systems that inhibit flow of particles over a certain size from one wellbore to another wellbore.

2. Background of the Art

Wells or wellbores are drilled in subsurface formations for the production of hydrocarbons (oil and gas). In some cases, multilateral wells are formed, wherein one or more wells are formed from a main wellbore. Sometimes lateral wellbores are also formed from one or more of the other lateral wellbores. Such a wellbore system is generally referred to a "multilateral wellbore" or a "multilateral wellbore system." Typically, the main wellbore is a cased wellbore, in that, it is lined with a metal casing (typically a jointed metallic tubular). In some cases the lateral wellbore is not lined with a casing, i.e., it is left as an open hole. Sand control and other flow control devices are installed at locations from which the formation fluid is extracted into the lateral wellbore. However, in open hole lateral wellbores, the junction between the main wellbore and the lateral wellbore includes no sand control devices that prevent the flow of particles, such as sand, from entering into the main wellbore from the lateral wellbore. Excessive sand production is detrimental to the equipment in the wellbores. This problem can be exacerbated when the open hole is formed in an unconsolidated formation, as such formations can produce excessive amounts of sand.

The disclosure herein provides wellbore systems that include sand control apparatus that inhibit or prevent flow of particles above a certain size from the junctions and the lateral wellbores into the main wellbore and methods of installing such apparatus.

SUMMARY

In one aspect, a wellbore system is disclosed that in one non-limiting embodiment includes a first wellbore capable of producing a fluid from a first formation, a second wellbore intersecting the first wellbore at a junction, wherein the second wellbore is an open hole and capable of producing a fluid from a second formation and a sand screen at the junction configured to inhibit particles larger than a selected size from flowing from the second wellbore and the juncture into the first wellbore.

In another aspect, a method of forming a wellbore is disclosed that in one non-limiting embodiment includes: forming a first wellbore capable of producing a fluid from a first formation; forming a second wellbore from a junction in the first wellbore; and placing a sand screen at or proximate to the junction to inhibit and/or prevent particles larger than a selected size from flowing from the second wellbore and the junction into the first wellbore.

Examples of the more important features of the apparatus and methods of the disclosure have been summarized rather broadly in order that the detailed description thereof that follows may be better understood, and in order that the contributions to the art may be appreciated. There are, of course, additional features that will be described hereinafter and which will form the subject of the claims.

BRIEF DESCRIPTION OF THE DRAWINGS

For a detailed understanding of the apparatus and methods disclosed herein, reference should be made to the accompanying drawing and the detailed description thereof, wherein:

The FIGURE is a schematic diagram of a non-limiting production multilateral wellbore system showing a cased main wellbore an open hole lateral wellbore and a sand screen at the junction of the main wellbore and the lateral wellbore for preventing flow of particles above a selected size from the junction into the main wellbore, according to one embodiment of the disclosure.

DESCRIPTION OF EXEMPLARY EMBODIMENTS

The FIGURE is a schematic diagram of a non-limiting production multilateral wellbore system 100 showing a main wellbore and a lateral wellbore with a screen at the junction of the main wellbore and the lateral wellbore for preventing flow of particles above a selected size from the junction, according to one embodiment of the disclosure. The system 100 is shown to include a main well or wellbore 110 formed in a formation 102 for producing fluid 118 from formation 102. The main wellbore 110 is shown as a cased wellbore that may be lined with a casing 104, which may be any suitable liner, including, but not limited to, a pipe made from joining pipe sections or another metallic liner. The wellbore 101 is shown to include cement 106 in the annulus 108 between the wellbore 110 and the casing 104. The casing 104 is shown to include a window 120 through which a lateral wellbore 180 has been formed to a depth 182. In the particular embodiment of the FIGURE, the lateral wellbore 180 is shown as an open hole, i.e., it is not lined with a casing, such as casing 104 in the main wellbore 110. For the purpose of this disclosure an open hole is at least partially not lined with a casing or liner. The lateral wellbore 180 and the main wellbore 110 form a junction 130 at the window 120. In the particular embodiment of system 100, the junction 130 between the main wellbore 110 and the lateral wellbore 180 is not sealed and thus fluid 132 from the formation 102 can flow from the formation 102 into the main wellbore 110 via the junction 130 as shown by arrows 133. For illustration purposes and not as a limitation, the wellbore system 100 is shown to include a single lateral wellbore 180. It will be understood that there may be more than one lateral wellbore formed from the main wellbore and/or from one of or more lateral wellbores. Furthermore, for the purpose of this disclosure, any or all such lateral wellbores may be open hole or cased-hole wellbores.

The lateral wellbore 180 includes inflow devices, such as a sand screen 184 and other devices, such as flow control devices (valves, pressure drop devices, etc. known in the art), collectively referred to by numeral 186. Fluid 188 from a production zone 190 may flow into the lateral wellbore 180 via devices 184 and 186, as shown by arrows 188*a*. The fluid 188 flows into the wellbore 180 and then into the main wellbore 110 at the junction 130, as shown by arrows 188*b*. As noted earlier, fluid 132 from the formation proximate the junction 130 also may flow into the main wellbore 110 as shown by arrows 133. In one non-limiting embodiment, a lateral liner 140 (sometimes referred to in the industry as "lateral hook liner") extends from a location 140*a* in the main wellbore 110 uphole (or above) of the junction 130 to a location 140*b* downhole (or below) of the junction 130 proximate to the screen 184 in the lateral well bore 180. The lateral liner 140 includes a through passage 144 that provides a through opening in the main wellbore 110 across the junction 130. The fluid 132 from the junction 130 flows or is directed to flow into the main wellbore 110 via fluid path 134 between the lateral liner 140 and the casing 104. The fluid 188, however, will generally flow into the main wellbore 110 from inside of the lateral liner 140, as shown by arrows 188*b*. Alternatively, the lateral liner may be located at any other suitable location in the wellbore system 100 so as to direct the fluid 132 from the junction toward the sand screen 160.

Still referring to the FIGURE, the main wellbore 110 is shown to include a production string 112 having a production tubing 114 that includes a window or opening 150 that in one embodiment may extend across the window 120, such as from a location 150*a* above the window 120 to a location 150*b* below the window 120. Seals, such as packers 134*a* and 134*b* are respectively placed between the tubing 114 and the casing 104 above and below the window 120 to cause the fluid 188*b* to flow from the lateral wellbore 180 into the production tubing 114 and to cause fluid 132 to flow into the production tubing via fluid path 136.

In one non-limiting embodiment, a flow control device, such as a sand screen 160 of sufficient length and size is placed in the production tubular 114 to inhibit or prevent flow of solid particles above a certain (selected) size in the fluid 132 and fluid 188*b* from entering the production tubing 114. In one aspect, the sand screen 160 may extend from a location 160*a* above the junction 130 to a location 160*b* below the junction 130. In one non-limiting embodiment, the sand screen 160 may be placed in a tubing 170 and placed inside the production tubing 114. Alternatively, the sand screen 160 may be placed in the lateral wellbore 180 or partially in the main wellbore 101 and partially in the lateral wellbore 180, each such screen adapted to or configured to inhibit or prevent solid particles above a size from entering the flow of the fluid toward the surface. In one non-limiting embodiment, the production tubing 114 includes an inward profile (also referred as indentations) 116 and the tubing 170 includes a collet 172 that is configured to engage with (mate with) the profile 116, so that when the collet 172 engages with the profile 116, the tubing 170 will securely hang inside the production tubing 114. In one embodiment, the tubing 170 also included another profile 176. To install or place the screen 160 in front of the junction 130, collet 175*a* on a run-in tool 175 is engaged with the profile 176 on the tubing 170 at the surface. The run-in tool 175 carrying the tubing 170 and the sand screen 160 is moved into the production tubing 114 until the collet 172 engages with the profile 116. In aspects, the force (pull force) required to dislodge the collet 172 from the profile 116 is greater than the pull force required to dislodge the collet 175*a* from the profile 176 and thus the run-in tool 175 from the profile 116. Once the tubing 170 has been placed in the production tubing 114, the run-in tool 175 is pulled out of the tubing 114, leaving the sand screen 160 in front of the junction 130. Seals 162*a* and 162*b* are provided between the tubing 170 and the production tubing 114 to prevent flow of the fluid from the lateral wellbore 180 or the junction 130 to bypass the sand screen 160. In other aspects, devices in addition to the sand screen may also be placed outside the screen (198) r inside the screen (189). For example, a flow control device, such as sliding sleeve valve, may be placed inside the sand screen 160 to control the flow of the fluid from the lateral wellbore 180. In another aspect, a flow control device that discriminates flow of one type of fluid against another type of fluid may be placed inside the sand screen 160. Such devices are known in the art and may include, but are not limited to, device having a tortuous fluid flow path; a device that inhibits flow of water compared to the flow of oil or gas; and a flow that created a greater pressure drop for water compared to oil or gas. Also, the sand screen may be any suitable sand screen.

The foregoing disclosure is directed to certain exemplary embodiments and methods. Various modifications will be apparent to those skilled in the art. It is intended that all such modifications within the scope of the appended claims be embraced by the foregoing disclosure. The words "comprising" and "comprises" as used in the claims are to be interpreted to mean "including but not limited to". Also, the abstract is not to be used to limit the scope of the claims.

The invention claimed is:

1. A wellbore system, comprising:

a first wellbore;

a second wellbore intersecting the first wellbore at a junction;

a production tubular in the first wellbore having an opening facing the second wellbore at the junction;

a first sand screen configured to inhibit flow of particles larger than a selected size from the junction to one of the first wellbore and the second wellbore, wherein the first sand screen extends from an upper location above the junction to a lower location below the junction, wherein the first sand screen is deployed in the production tubular;

a second sand screen disposed within the second wellbore; and a first seal between the production tubular and the first sand screen proximate to a lower end of the first sand screen and a second seal proximate to an upper end of the first sand screen.

2. The wellbore system of claim 1, wherein the junction is exposed to a formation.

3. The wellbore system of claim 1, wherein the first sand screen is disposed proximate to the junction.

4. The wellbore system of claim 1, wherein the first sand screen is disposed as one of: in the first wellbore; in the second wellbore; and partially in the first wellbore and partially in the second wellbore.

5. The wellbore system of claim 1 further comprising a liner that directs flow of a fluid from the junction toward the first sand screen.

6. The wellbore system of claim 5, wherein the liner is disposed as one of: from a location in the first wellbore to a location in the second wellbore; in the first wellbore; in the second wellbore; and partially in the first wellbore and partially in the second wellbore.

7. The wellbore system of claim 1, wherein the second wellbore includes a flow control device that controls flow of a formation fluid into the second wellbore.

8. The wellbore system of claim 1 further comprising a first seal between a production tubular in the first wellbore and a casing in the first wellbore uphole of the junction and a second seal between the production tubular and the casing downhole of the junction to enable fluid from the second wellbore and the junction to flow through the first sand screen.

9. The wellbore system of claim 1, wherein one of the first wellbore and the second wellbore is a cased wellbore and the other of the first wellbore and the second wellbore is an open hole.

10. The wellbore system of claim 1 further comprising a flow control device inside the first sand screen that controls flow of the fluid from the second wellbore into the first wellbore.

11. The wellbore system of claim 10, wherein the flow control device is selected from a group consisting of: a valve, an inflow control device having a tortuous fluid flow path; and a device that inhibits flow of water compared to the flow of oil or gas.

12. A method of forming a wellbore, comprising:

forming a first wellbore;

forming a second wellbore intersecting the first wellbore at a junction;

placing a production tubular in the first wellbore having an opening facing the second wellbore at the junction; and placing a first sand screen configured to inhibit particles larger than a selected size from flowing from the junction into one of the first wellbore and the second wellbore, wherein the first sand screen extends from an upper location above the junction to a lower location below the junction, wherein the first sand screen is deployed in the production tubular;

placing a second sand screen disposed within the second wellbore; and providing a first seal between the production tubular and the first sand screen and a second seal between the production tubular and the first sand screen to inhibit flow of fluid from the second wellbore to outside of the first sand screen.

13. The method of claim 12 further comprising providing a casing in the first wellbore and exposing the junction to a formation.

14. The method of claim 12 further comprising: placing a liner that directs fluid to flow from the junction to one of the first wellbore and second wellbore.

15. The method of claim 12 further comprising providing a first seal between the production tubular and the first wellbore uphole of the junction and a second seal between the production tubular and the first wellbore downhole of the junction to enable the fluid from the second wellbore and the junction to flow through the first sand screen.

16. The method of claim 12, wherein the second wellbore is an open hole.

17. The method of claim 12 further comprising providing a flow control device inside the first sand screen that controls flow of the fluid from the second wellbore into the first wellbore.

18. The method of 17, wherein the flow control device is selected from a group consisting of: a sleeve valve, an inflow control device having a tortuous fluid path; a device that inhibits flow of water compared to the flow of oil or gas.

* * * * *